US007663454B2

(12) United States Patent
Bates

(10) Patent No.: US 7,663,454 B2
(45) Date of Patent: Feb. 16, 2010

(54) DISCRETE DIELECTRIC MATERIAL CAVITY RESONATOR AND FILTER HAVING ISOLATED METAL CONTACTS

(75) Inventor: David Allen Bates, Fayetteville, NY (US)

(73) Assignee: Dielectric Laboratories, Inc., Cazenovia, NY (US)

( * ) Notice: Subject to any disclaimer, the term of this patent is extended or adjusted under 35 U.S.C. 154(b) by 254 days.

(21) Appl. No.: 11/547,947

(22) PCT Filed: Apr. 8, 2005

(86) PCT No.: PCT/US2005/011930

§ 371 (c)(1),
(2), (4) Date: Oct. 6, 2006

(87) PCT Pub. No.: WO2005/099401

PCT Pub. Date: Oct. 27, 2005

(65) Prior Publication Data

US 2008/0018391 A1 Jan. 24, 2008

Related U.S. Application Data

(60) Provisional application No. 60/560,924, filed on Apr. 9, 2004.

(51) Int. Cl.
*H01P 1/20* (2006.01)

(52) U.S. Cl. ..... 333/202; 333/208; 333/219.1

(58) Field of Classification Search ..... 333/202, 333/208, 209, 206, 212, 219, 219.1
See application file for complete search history.

(56) References Cited

U.S. PATENT DOCUMENTS

| | | | | |
|---|---|---|---|---|
| 4,668,925 | A * | 5/1987 | Towatari et al. | 333/219.1 |
| 4,691,179 | A | 9/1987 | Blum et al. | |
| 5,557,246 | A * | 9/1996 | Ishihara et al. | 333/206 |
| 5,629,656 | A * | 5/1997 | Tada et al. | 333/202 |
| 5,926,079 | A * | 7/1999 | Heine et al. | 333/208 |
| 6,005,456 | A * | 12/1999 | Matsumoto et al. | 333/202 |
| 6,122,489 | A * | 9/2000 | Yorita | 333/202 |
| 6,133,808 | A | 10/2000 | Arakawa | |
| 6,160,463 | A | 12/2000 | Arakawa et al. | |
| 6,470,198 | B1 | 10/2002 | Kintaka et al. | |
| 6,566,986 | B2 | 5/2003 | Sano et al. | |
| 6,569,795 | B2 | 5/2003 | Kono et al. | |
| 7,449,980 | B2 * | 11/2008 | Bates | 333/202 |
| 2004/0085165 | A1 * | 5/2004 | Chung | 333/206 |

* cited by examiner

*Primary Examiner*—Benny Lee
(74) *Attorney, Agent, or Firm*—Burr & Brown

(57) ABSTRACT

A discrete resonator is provided, including a dielectric base having a dielectric constant. A metal contact formed on a major surface of the dielectric base has a predetermined area and is positioned at a predetermined location on the dielectric base to provide a predetermined loaded Q for the resonator. A metal ground coating is formed on the outer surface of the dielectric base with the exception of an isolation region surrounding the metal contact that is free of the metal ground coating. The area of the isolation region is sufficient to prevent significant coupling between the metal contact and the metal ground coating. The dielectric constant of the material used for the base, and the width and length of the dielectric base are each selected such that the resonator resonates at least at one predetermined resonant frequency in the GHz frequency range.

14 Claims, 8 Drawing Sheets

DISCRETE DIELECTRIC MATERIAL CAVITY RESONATOR AND FILTER HAVING ISOLATED METAL CONTACTS

FIELD OF THE INVENTION

The present invention relates to a discrete resonator made of a dielectric material (preferably ceramic), and in particular to a discrete resonator containing a single layer of ceramic dielectric material covered with a metal ground coating and a metal contact in contact with the dielectric, but electrically isolated from the metal ground coating.

BACKGROUND OF THE INVENTION

Electrical resonators are used in a variety of electrical circuits to perform a variety of functions. Depending upon the structure and material of the resonator, when an AC signal is applied to the resonator over a broad frequency range the resonator will resonate at specific resonant frequencies. This characteristic allows the resonator to be used, for example, in an electrical filter that is designed to pass only frequencies in a preselected frequency range, or to attenuate specific frequencies.

Resonators are also used in high frequency applications, such as optical communication systems which operate in the GHz range. In these types of applications, resonators are used, for example, to stabilize the frequency of oscillators in repeater modules that are provided along an optical communication transmission line. These types of resonators must exhibit high Q values in order to provide the necessary oscillator frequency stability and spectral purity, and also maintain low phase noise.

There are several types of such high Q resonators known in the art. For example, cavity resonators, coaxial resonators, transmission line resonators and dielectric resonators have all been used in high Q applications. Cavity and dielectric resonators, however, are difficult to mass produce in an efficient manner, because these devices consist of machined parts. There is also significant manual labor involved in assembling the devices and mounting them to circuit boards, as well as in tuning the devices to the desired resonant frequency.

Ceramic coaxial resonators are also relatively expensive to mass produce as they are individually machined and tested to achieve the desired resonant frequency. In surface mount applications, they are typically limited to frequencies less than 5 GHz due to dimensions, parasitics and spurious modes.

Transmission line resonators, typically microstripline, can be easily fabricated along with interconnection traces on a printed circuit board. This technique can provide only low performance resonators. They are low Q, typically <80, and have poor frequency stability with changing temperature resulting from material properties and geometry. Microstripline resonators are also inherently un-shielded and therefore affected by materials and components in proximity to them. Moreover, transmission line resonators are typically large in size, which is a serious issue in the constant drive to miniaturize electronic components.

Dielectric resonators take the shape of a disc or cylinder. Typical 2 GHz dielectric resonators are about one inch in diameter and one-half inch high. Typical 10 GHz dielectric resonators are about 0.25 inches in diameter and 0.1 inches high. This resonator achieves very high Q because of its size and lack of metallic losses, and is capable of providing excellent frequency stabilization in the GHz range. This device, however, tends to occupy too much real estate to be useful in most microelectronic applications particularly when housing requirements are included. In addition, this device must be fully shielded in a housing to prevent interference by and with surrounding components on the circuit board. Moreover, these products are manufactured by iteratively machining and testing until the desired resonant frequency is achieved. Consequently, this known device is also relatively expensive to mass produce and difficult to assemble on a circuit board.

It would be desirable to provide a high Q resonator that can be designed to resonate at a variety of specific resonant frequencies, but at the same time be simple in structure and inexpensive to mass produce using proven materials (e.g., ceramics) and proven microelectronic techniques (e.g., lithography). To date, however, no such resonator exists.

SUMMARY OF THE INVENTION

It is an object of the present invention to provide a discrete, high Q resonator that can be designed to resonate at a variety of specific resonant frequencies, but at the same time be simple in structure and inexpensive to mass produce.

According to one embodiment of the present invention, a discrete resonator is provided that includes a dielectric base made of a dielectric material having a dielectric constant, and having a width, a length greater than or equal to the width defined between a first end and an opposed second end of the base, a thickness, and an outer surface defining first and second opposed major surfaces, peripheral side surfaces and first and second end surfaces of the dielectric base. A metal contact having a predetermined area is formed in a predetermined location on one of the first and second major surfaces of the dielectric base to provide a predetermined loaded Q and input impedance for the resonator. A metal ground coating covers the outer surface of the dielectric base with the exception of an isolation region that is free of the metal ground coating surrounding the metal contact. The isolation region has an area sufficient to prevent significant coupling between the metal contact and the metal ground coating. The dielectric constant of the material used for the base, and the width and length of the dielectric base are selected such that the resonator resonates at least at one predetermined resonant frequency in the GHz frequency range.

According to another embodiment of the present invention, a discrete resonator is provided that includes a dielectric base made of a dielectric material having a dielectric constant, and having a width, a length greater than or equal to the width defined between a first end and an opposed second end of the base, a thickness, and an outer surface defining first and second opposed major surfaces, peripheral side surfaces and first and second end surfaces of the dielectric base. A first metal contact having a predetermined area is formed in a predetermined location on one of the first and second major surfaces of the dielectric base proximate the first end thereof, and a second metal contact having a predetermined area is formed in a predetermined location on one of the first and second major surfaces of the dielectric base proximate the second end thereof. A metal ground coating covers the outer surface of the dielectric base with the exception of first and second isolation regions that are free of the metal ground coating respectively surrounding the first and second metal contacts. The isolation regions each have an area that is sufficient to prevent significant coupling between the first and second metal contacts and the metal ground coating. The dielectric constant of the material used for the base, and the width and length of the dielectric base are selected such that the resonator resonates at least at one predetermined resonant frequency in the GHz frequency range. The predetermined areas and the predetermined positions of the first and second metal contacts respectively provide predetermined loaded Q values for the resonator with respect to the first and second metal contacts. An electric transfer function between the first metal contact and the second metal contact implements a band pass filter response.

While any dielectric material could be used, the use of ceramic materials for the dielectric base is preferred, because these materials allow the resonant frequency of the resonator to be controlled simply by selecting a material with a predetermined dielectric constant, and then forming the base to have a selected width and length. In addition, conventional microelectronic fabrication techniques can be employed to control the size and location of the metal contact, to thus control the loaded Q and input impedance for the ceramic resonator. Still further, since the metal ground coating shields the electromagnetic energy within the dielectric base, it is unnecessary to provide a separate housing to shield the resonator. As a result of all of the above, the resonator of the present invention can be manufactured to exhibit a wide range of resonant frequencies and preselected Q values, all at a significantly reduced manufacturing cost compared to the prior art resonators.

The discrete resonator of the present invention can easily operate at resonant frequencies in the range of 1 GHz to 80 GHz, and can exhibit loaded Q values in the range of 50 to over 2000. This enables the resonator to be used in a wide variety of applications. In addition, due to its discrete structure and controllable Q, the resonator is particularly suitable for stabilizing oscillator frequencies in communication systems.

Other preferred embodiments of the present invention will be described below in more detail.

BRIEF DESCRIPTION OF THE DRAWINGS

For a better understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
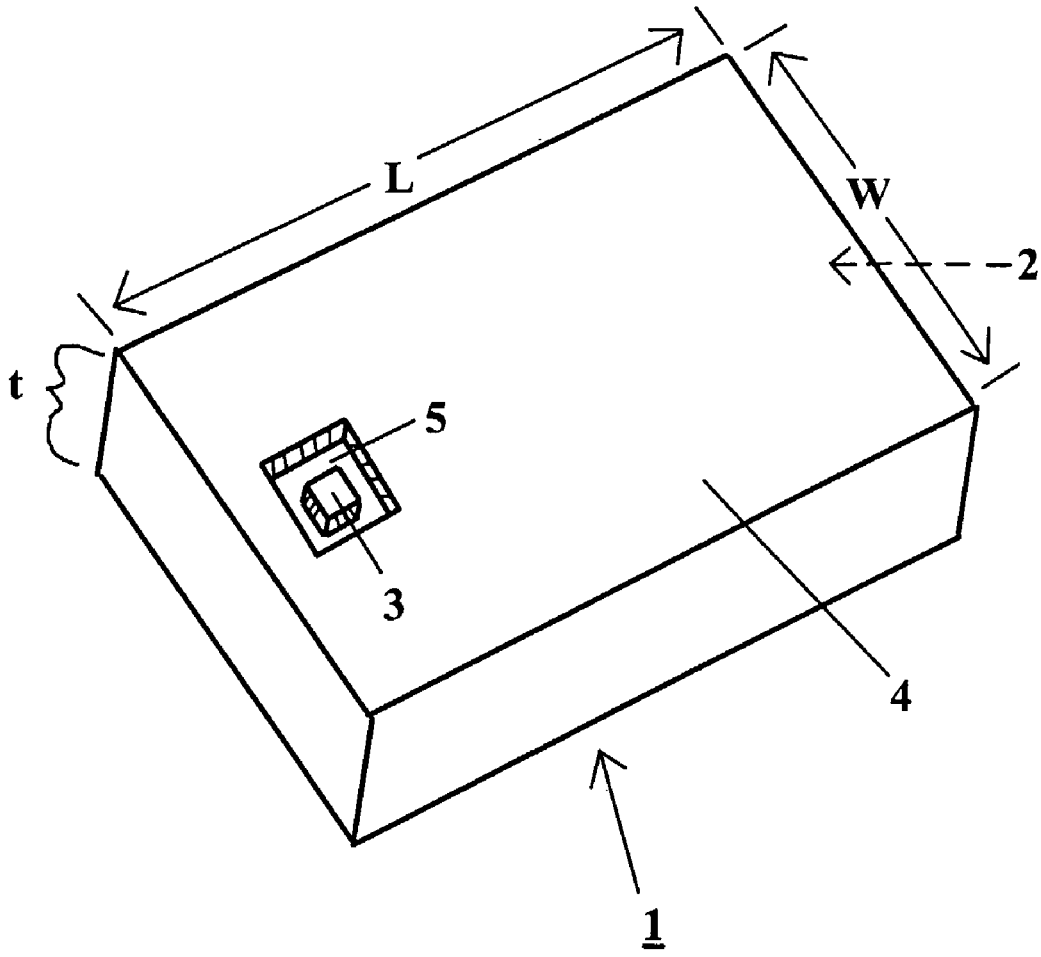
FIG. 1 is a perspective view of a ceramic resonator according to one embodiment of the present invention.
Figure 2:
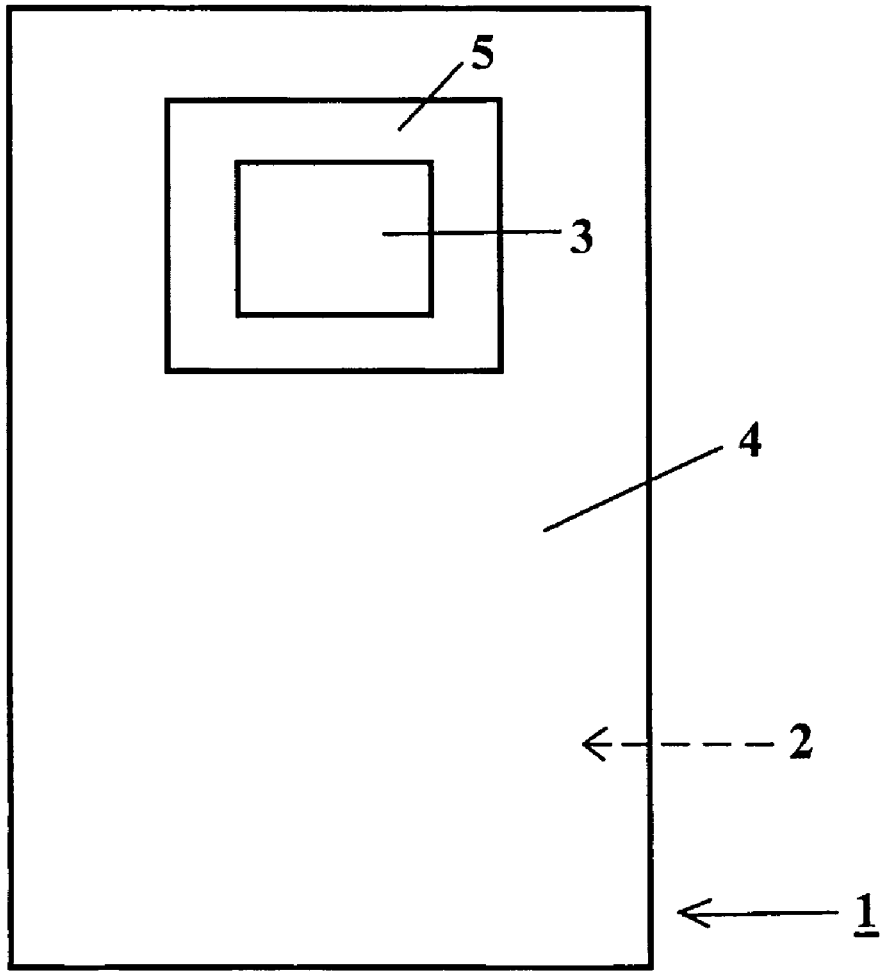
FIG. 2 is a plan view of the upper surface of the ceramic resonator shown in FIG. 1.

FIGS. 1 and 2 show a ceramic resonator 1 according to one embodiment of the present invention. The resonator 1 includes a dielectric base 2 that has a width (W), a length (L) that is greater than or equal to the width, a thickness (t) and two, opposed major surfaces, as best shown in FIG. 1, for example. The opposed major surfaces of the dielectric base 2 itself cannot be seen in FIGS. 1 and 2, because substantially the entire outer surface of the dielectric base is covered by a metal ground coating 4, as discussed below in more detail. In addition, it should be understood that "W," "L" and "t" in FIG. 1 (and FIG. 8) designate the width, length, and thickness of the underlying dielectric base 2 that is covered by the metal ground coating 4. Like reference numerals and symbols are used to denote like structures in all of the drawing figures, and repeated descriptions of similar reference numerals are omitted.

A metal contact 3 is formed on one of the major surfaces of the dielectric base 2 (e.g., the upper surface as shown in FIG. 1), and is isolated from the metal ground coating 4 by an isolation region 5. The size of the isolation region 5 is selected to be consistent with desired input impedance between the metal contact 3 and the metal ground coating 4. For example, when the dielectric base 2 is on the order of 0.18 inches (W)×0.18 inches (L), and the device is intended to operate at around 10 GHz, the isolation region 5 should be about 0.01 inches wide.

While the metal material used to form the metal contact 3 and metal ground coating 4 is not particularly limited, gold, copper and silver are examples of metals that could be used. Metals with high electrical conductivity are desirable for high Q. Superconductor surface metals can be employed to further enhance Q. The surface of the metal contact 3 and the metal ground coating 4 can also include a surface finish comprising nickel plating or gold plating, for example.

The thickness of the metal contact 3 and metal ground coating 4 is also not particularly limited, but should be at least three "skin depths" thick at the operating frequency for high Q. In the context of a 10 GHz resonator using gold or copper metal, for example, the metal contact 3 and metal ground coating 4 should be about 100 micro-inches thick. As the frequency of the device increases, the thickness of metal necessary to enable optimum Q of the device can be decreased.

The dielectric base 2 can be made of any ceramic dielectric material that has a dielectric constant that does not change significantly with temperature. In addition, the dielectric material must also have a predictable, homogeneous dielectric constant and a low loss tangent. If the ceramic resonator is to operate in a GHz frequency range, the dielectric constant of the material should typically be less than 100 for temperature stability, and the loss tangent should be less than 0.005, commensurate with the desired resonator Q. Suitable dielectric materials include fused silica, $Al_2O_3$, as well as MgO-based ceramics sold under the trade name CF by Dielectric Laboratories, Inc.

The resonator can be designed to resonate at a variety of predetermined resonant frequencies by using a material that has a dielectric constant of less than 100 and by carefully selecting the width and length of the dielectric base 2. While the resonant frequency would be determined based on the particular application for the resonator, in the context of a resonator that will be used to stabilize the frequency of an oscillator in a telecommunications system, the resonant frequency would be on the order of 1 to 45 GHz. The resonator design of the present invention enables the manufacture of resonators that resonate at any frequency within this entire range simply by changing the length/width and/or dielectric constant of the dielectric base.

In the resonator 1 shown in FIG. 1, the length (L) of the dielectric base 2 is greater than the width (W) thereof. It is preferred that W/L ratio is in a range of 0.6 to 1.0. The largest separation between resonant frequencies and maximum Q is realized for W/L=1.0. The lowest frequency resonant mode of this structure is the $TE_{101}$ mode, which results in a maximum electric field distribution within the dielectric base 2 in the two-dimensional center of the dielectric base 2. In this way, the coupling between the metal contact 3 and the electromagnetic energy within the dielectric base 2 can be controlled by positioning the metal contact at selected locations on the dielectric base 2. For example, the coupling between metal contact 3 and the electromagnetic energy within the dielectric base 2 would be maximum at the two-dimensional center of the dielectric base 2.

In order to increase the loaded Q that the external circuit experiences when connected to the resonator, however, it is necessary to reduce the coupling between the metal contact 3 and the electromagnetic energy. Accordingly, the metal contact 3 can be moved away from the geometric center of the dielectric base 2 to reduce coupling. In the device shown in FIGS. 1 and 2, the contact 3 is positioned along a longitudinal center line of the resonator, but is located toward one of the two opposed ends of the dielectric base 2 of the resonator, rather than the geometric center of the dielectric base 2. The coupling is reduced significantly in this manner.

Figure 3:
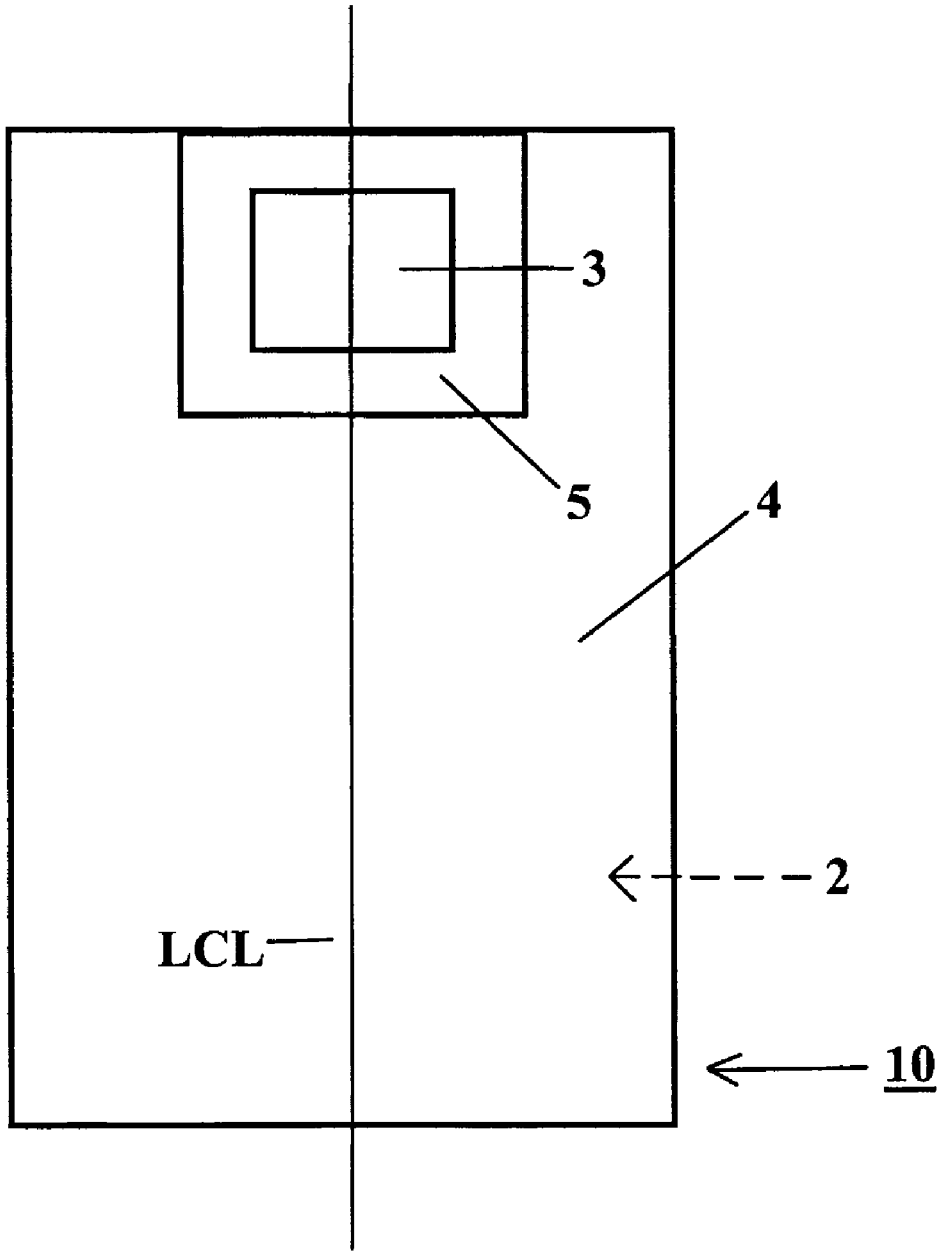
FIG. 3 is a plan view of the upper surface of a ceramic resonator according to another embodiment of the present invention.

FIG. 3 is a plan view showing another embodiment of a ceramic resonator 10 according to the present invention. In this embodiment, the metal contact 3 is positioned even closer to the longitudinal end of the resonator 10, and is centered on the longitudinal center line (LCL) of the resonator 10. This arrangement further reduces the coupling between the metal contact 3 and the electromagnetic energy within the dielectric base 2.

Figure 4:
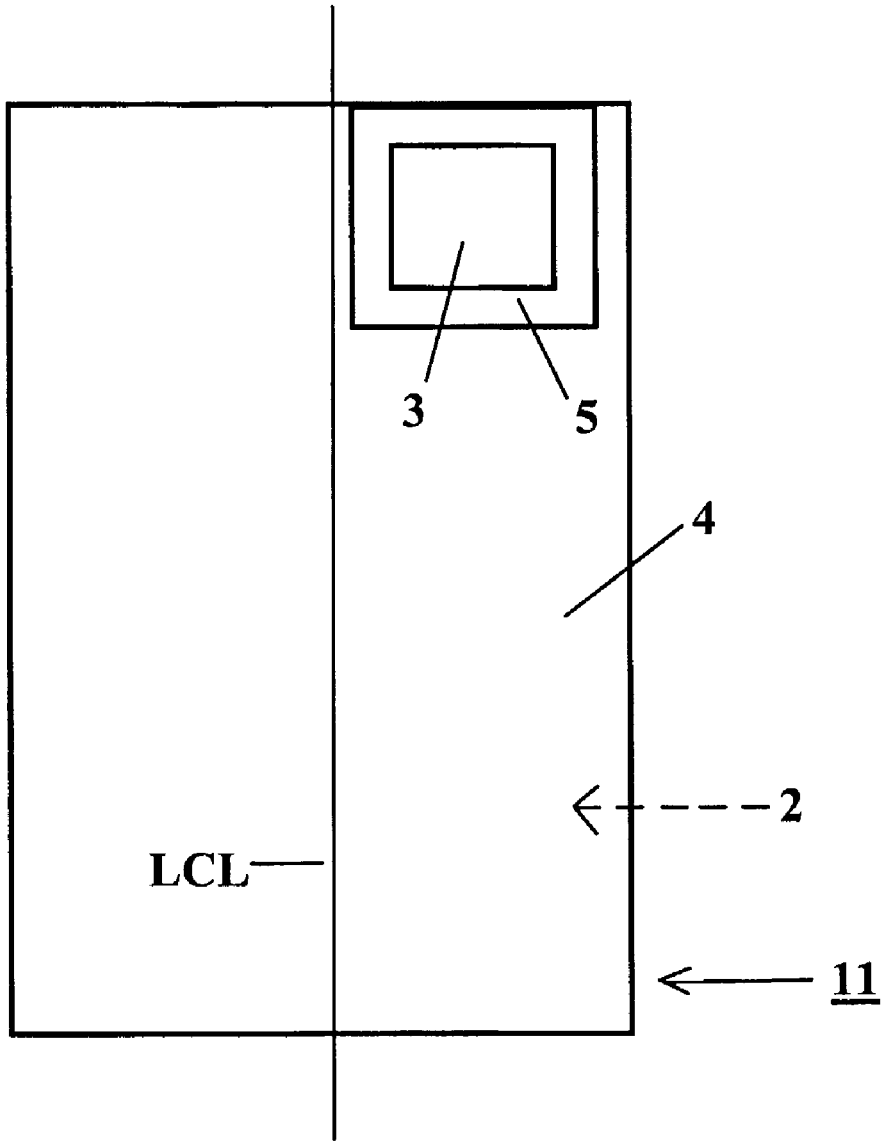
FIG. 4 is a plan view of the upper surface of a ceramic resonator according to another embodiment of the present invention.

FIG. 4 is a plan view showing another embodiment of a ceramic resonator 11 according to the present invention. The metal contact 3 is positioned proximate one of the longitudinal ends of the resonator, but is also offset with respect to the longitudinal center line (LCL) of the resonator 11. The depicted geometry of the dielectric base 2 will focus the electromagnetic energy not only in the two-dimensional center of the dielectric base 2, but also along the longitudinal center line (LCL) of the dielectric base 2. The embodiment shown in FIG. 4 further reduces the coupling between the metal contact 3 and the electromagnetic energy within the dielectric base 2 by positioning the metal contact 3 further from the two-dimensional center of the dielectric base, that is, proximate an end of the resonator, and by offsetting the lateral position of the metal contact 3 with respect to the longitudinal center line (LCL) of the resonator.

As explained above, in high frequency applications, especially in the GHz frequency range, it is necessary for the resonator to exhibit a high Q of at least 100. In many voltage controlled oscillator (VCO) applications, it is also important, however, that the resonator not exhibit too high a loaded Q, in order to allow sufficient electronic tuning of an oscillator. Specifically, if the resonator has a loaded Q in a range of 100-200, it will provide sufficient frequency stabilization characteristics, but also have enough bandwidth to allow the oscillator to be tuned to some degree around the natural resonant frequency of the resonator. This electronic tunability enables a group of oscillators to be adjusted to an exact frequency within a prescribed frequency range, thus compensating for oscillator/resonator manufacturing tolerance as well as affects of operating environment, such as temperature and supply voltage.

The loaded Q of the resonator is defined, in large part, by the degree of coupling between the metal contact 3 and the electromagnetic energy within the dielectric base 2. Thus, the amount of coupling can be changed by changing the size of the metal contact 3 and by changing the position of the metal contact with respect to those areas within the dielectric base 2 where the electromagnetic energy is greatest. Again, as explained above with respect to FIGS. 1-4, in the design of the present resonator, the electromagnetic energy is greatest in the two-dimensional center of the dielectric base 2, as well as along the longitudinal center line thereof. By selecting the position of the metal contact 3 with respect to these areas of maximum electric field strength, the coupling can be controlled, and thus, the Q of the overall device can be accurately controlled.

In the context of the present invention, the Q of the resonator is particularly easy to control because the size and position of the metal contact 3 are established using standard lithographic techniques. As such, any given resonator can be formed to exhibit a very specific Q, which ultimately controls the loaded Q experienced by the external circuit. In addition, the use of lithographic techniques also provides precise control over the size of the isolation region 5 to dictate the input impedance of the device, which is also desirable when implementing the resonator in different external circuits.

The resonator in accordance with the present invention provides significant advantages over the resonators currently available. For example, as a single discrete unit, the resonator can provide a relatively high loaded Q that has heretofore been available only with the more complicated (and thus more expensive) resonators discussed above. Secondly, the same basic design can be implemented across a wide variety of applications simply by changing the length/width ratio and/or the dielectric constant of the dielectric base. The thickness of the dielectric base can be adjusted over a range commensurate with fabrication methods and desired unloaded resonator Q. The Q increases with thickness up to a threshold where the resonator supports the $TE_{111}$ mode as well as the $TE_{101}$ mode (the lowest frequency mode). In addition, the use of lithographic techniques to control the position and size of the metal contact provides wide latitude in controlling the loaded Q of the resonator to thus satisfy a variety of potential circuit requirements.

The resonator of the present invention has other advantages over the prior art. For example, if the footprint on the circuit board is predefined such that the resonator must fit within that footprint, the dielectric constant of the material used to form the dielectric base 2 could be easily changed to achieve the desired resonant frequency with only a minimal change in the length and width dimensions of the dielectric base. In addition, the thickness of the dielectric base 2 could also be varied to contribute to greater control of the Q of the resonator.

Another advantage of the resonator according to the present invention, as shown in FIGS. 1-4, for example, is that it is self-shielding. Specifically, since the entire outer surface of the dielectric base 2 is covered by the metal ground coating 4, with the exception of the metal contact 3 and isolation region 5, the electromagnetic energy within the dielectric base 2 is confined by the metal coating 4. Accordingly, unlike prior art resonators, it is not necessary to provide an additional housing surrounding the resonator to prevent interference by or with other components of the circuit board on which the resonator will be used. Moreover, the self-shielding feature attributed to the resonator according to the present invention eliminates the dependency of the resonator frequency and Q on the materials within the surrounding shield housing. This also simplifies the design, manufacture and testing procedures for products utilizing the resonators.

Figure 5:
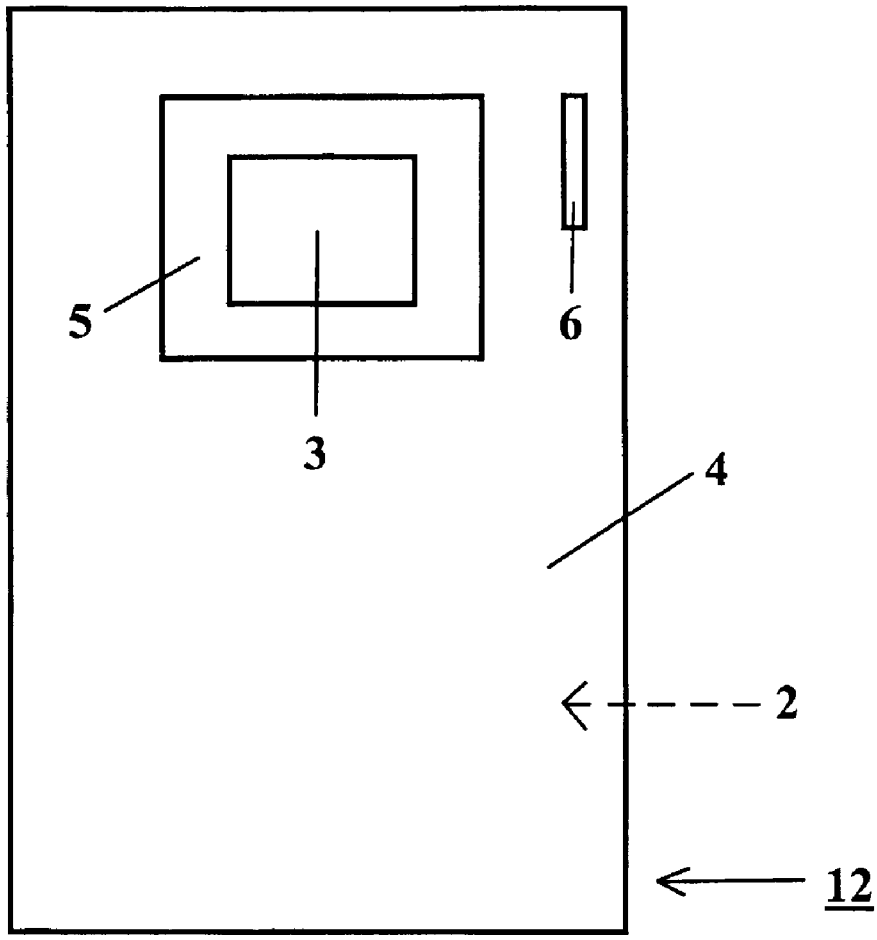
FIG. 5 is a plan view of a ceramic resonator as shown in FIG. 1, with part of the metal ground coating removed to adjust the resonant frequency of the resonator.

FIG. 5 is a plan view showing a ceramic resonator 12 according to another embodiment of the present invention. The resonator 12 is essentially identical to resonator 1 shown in FIGS. 1 and 2, except that a slot 6, which is essentially an additional region that is free of the metal ground coating 4, is provided to expose a portion of the surface of the dielectric base 2. By removing this portion of the metal ground coating 4, the resonant frequency of the resonator 12 can be further adjusted after the primary manufacturing steps have been completed. For example, thousands of resonators 1 (shown in FIG. 1) could be manufactured in an identical manner, and then specific ones of those resonators 1 could each be further processed into resonators 12 by forming slot 6 therein, such that those resonators 12 could be tuned to a resonant frequency other than the resonant frequency at which resonator 1 would originally operate. This provides further latitude of device design, improved resonant frequency tolerance control and additional cost savings in mass production.

Figure 6:
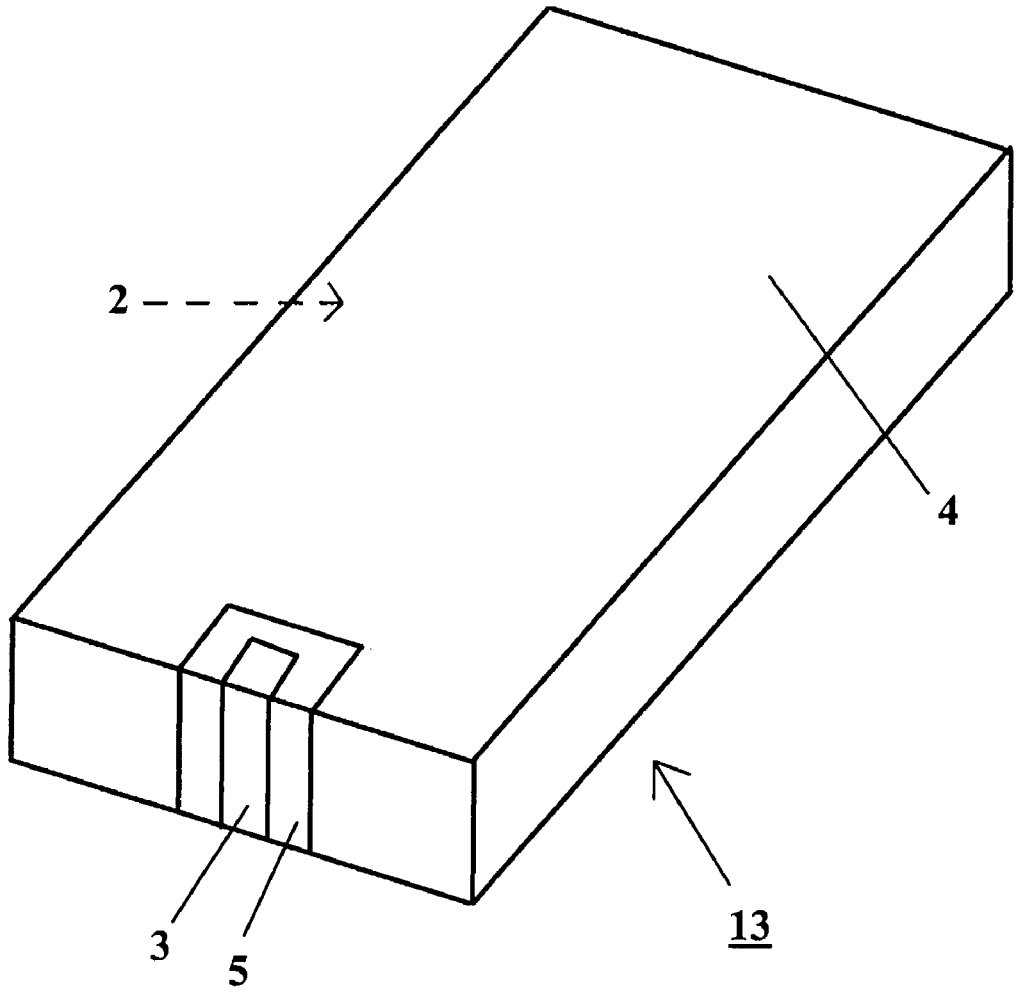
FIG. 6 is a perspective view of a ceramic resonator according to another embodiment of the present invention.

FIG. 6 is a plan view showing another embodiment of a ceramic resonator 13 according to the present invention, wherein the metal contact 3 extends from the upper major surface of the dielectric base 2 along one end of the dielectric base 2 toward the other major surface thereof. The isolation region 5 also extends along the end of the dielectric base wherein the input signal generates magnetic field coupling with the resonator 13 via the shorted input edge trace. This embodiment offers a wider range of input impedance.

Figure 7:
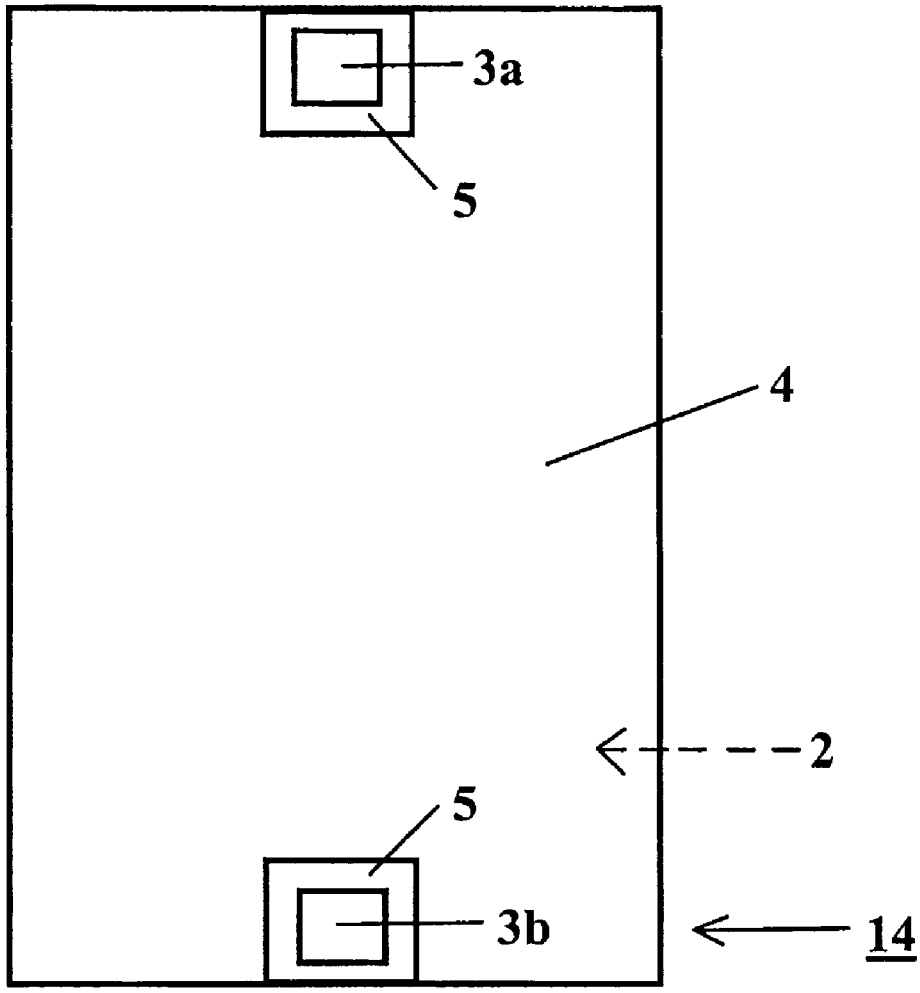
FIG. 7 is a plan view of the upper surface of a ceramic resonator according to another embodiment of the present invention.

FIG. 7 is a plan view showing another embodiment of a ceramic resonator 14 according to the present invention, which includes two metal contacts 3*a* and 3*b* positioned at opposite ends of the dielectric base 2. In all other respects, however, this resonator is identical to the resonators explained above with respect to FIGS. 1-5, but since resonator 14 has two ports (3*a*, 3*b*), it can also be used as a band pass filter. In that manner, resonator 14 can be designed to implement a one-pole characteristic, as well as two or more poles, by appropriately designing the resonator 14 to support two or more specific resonant modes in conjunction with appropriate coupling coefficients.

Figure 8:
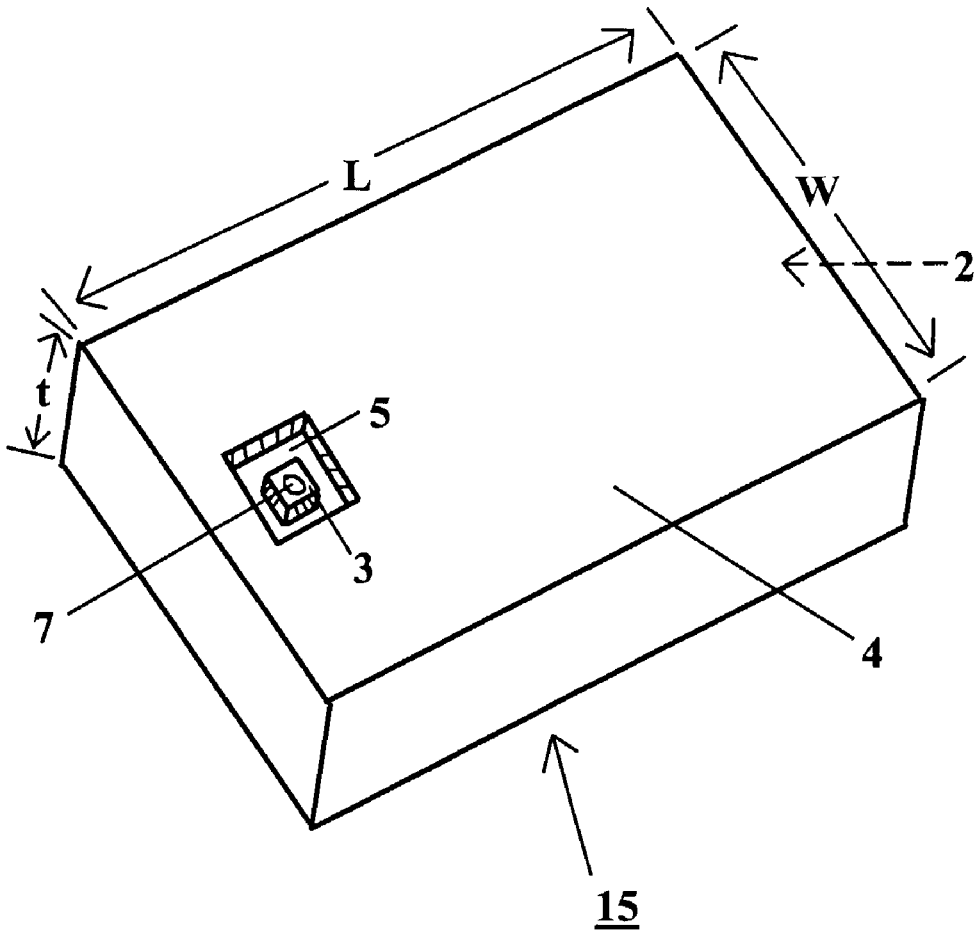
FIG. 8 is a perspective view of a ceramic resonator according to another embodiment of the present invention.

FIG. 8 is a perspective view of another embodiment of a resonator 15 according to the present invention. The resonator 15 includes a conductive via 7 that extends between the metal contact pad 3 on one major surface of the dielectric base 2 (e.g., the upper surface as shown in FIG. 8) and the ground coating 4 covering the other opposed major surface of the dielectric base 2 (e.g., the lower surface as shown in FIG. 8). In this embodiment, a high frequency electrical signal input to the metal contact 3 will generate magnetic field coupling within the dielectric base 2. That is, due in part to the inductance of the conductive via 7, the energy coupled into the dielectric base 2 is primarily magnetic rather than electrical, as is the case with the resonators shown in FIGS. 1-5.

The level of magnetic coupling achieved in resonator 15 according to this embodiment of the present invention varies according to the position of the metal contact 3 (and the conductive via 7 therein) on the dielectric base 2 in a similar manner as the electric field variations described above in connection with the resonators shown in FIGS. 1-5. That is, in resonator 15, a maximized current can be realized when the metal contact 3 is positioned proximate or at an end of the dielectric base 2 along a longitudinal center line thereof. Unlike the prior embodiments, tighter levels of coupling within the dielectric base 2 are desirable in that an external variable element (such as a varactor, for example) can be used to tune the resonator 15 over a wide frequency range. While it is recognized that the benefit of being externally tunable is at the cost of Q, the trade off with oscillator stability can be acceptable in certain applications in order to provide external tunability over a wide frequency range.

All of the resonators described above can be manufactured using standard ceramic and microelectronic fabrication techniques. For example, the dielectric base 2 can be formed as a single green layer of ceramic material and then fired, or formed as a plurality of green tapes that are laminated and then fired. In both cases, the resulting fired body is a single piece of monolithic ceramic material that exhibits the necessary dielectric properties.

The metal contact 3 and metal ground coating 4 can also be formed using conventional techniques, such as RF sputtering and/or plating. It is preferred that the metal ground coating 4 is formed initially to cover the entire outer surface of the dielectric base 2 (e.g., both major surfaces, the peripheral side surfaces and the end surfaces). The isolation region 5 can then be formed using lithographic techniques, which thereby defines the metal contact 3, as well.

All of these techniques make the ceramic resonator according to the present invention relatively inexpensive to manufacture. While exemplary methods have been described above, it is sufficient that any conventional microelectronic fabrication method could be used to form the resonators in accordance with the present invention.

Specific examples will now be explained, with the understanding that the present invention is by no means limited to any of these specific examples.

EXAMPLE 1

A plurality of green sheets of CF dielectric ceramic were laminated and fired to form a dielectric base having a width of 0.150 inches, a length of 0.220 inches and a thickness of 0.015 inches. The dielectric constant of the material was 22 and the loss tangent of the material was 0.0003. All of the exposed surfaces of the dielectric base are gold metallized to a thickness of 0.00015 inches. A square isolation region 0.010 inches wide was formed to define a square metal contact (as shown in FIG. 2) 0.030 inches on a side. The metal contact was positioned on the dielectric base such that its outer most edge in the longitudinal direction of the resonator was spaced from the end of the resonator by 0.030 inches.

The ceramic resonator was attached to a Network analyzer and subjected to a frequency sweep of 9 to 20 GHz, which showed that the ceramic resonator exhibited a first order resonant mode at a frequency of 10.25 GHz, and higher order resonant modes at frequencies of 13.9 and 18.2 GHz. The lowest resonant mode exhibited a loaded Q of 100.

EXAMPLE 2

A ceramic resonator was formed in the same manner as described above in Example 1, except that the metal contact was positioned on the surface of the dielectric base such that its outer most edge in the longitudinal direction of the resonator was spaced from the end of the resonator by 0.020 inches.

When tested on the Network analyzer, this ceramic resonator exhibited a resonant frequency of 10.30 GHz and a loaded Q of 170.

EXAMPLE 3

A ceramic resonator was formed in the same manner as described above in Example 1, except that the square metal contact pad was 0.020 inches on a side, was positioned spaced from the end of the ceramic resonator only by the width of the isolation region, and was also shifted to the right of the longitudinal center line of the resonator by a distance of 0.030 inches.

When tested on the Network analyzer, this ceramic resonator exhibited a resonant frequency of 10.22 GHz with a loaded Q of 310.

While the present invention has been particularly shown and described with reference to the preferred mode as illustrated in the drawings, it will be understood by one skilled in the art that various changes in detail may be effected therein without departing from the spirit and scope of the invention as defined by the claims. For example, and as stated above, while the description pertains mainly to ceramic materials, other dielectric materials, such as dielectric glasses and polymers, could be used.

I claim:

1. A discrete cavity resonator consisting essentially of:

a single cavity dielectric base comprising a dielectric material having a dielectric constant, said dielectric base having a width, a length greater than or equal to said width defined between a first end edge and an opposed second end edge of said dielectric base, a thickness and an outer surface defining first and second opposed major surfaces, peripheral side surfaces and first and second opposed end surfaces of said dielectric base;

at least one metal contact having a predetermined area disposed in a predetermined location only on one of said first and said second major surfaces of said dielectric base to provide a predetermined loaded Q for said resonator, said metal contact being capacitively coupled to said single cavity of said dielectric base;

a metal ground coating entirely covering said outer surface of said dielectric base with the exception of said at least one metal contact and at least one isolation region formed on said one of said first and said second major surfaces which is free of said metal ground coating, said at least one isolation region surrounding said at least one metal contact and having an area sufficient to prevent significant coupling between said at least one metal contact and said metal ground coating;

wherein said dielectric constant, said width and said length of said dielectric base are each selected such that said discrete resonator resonates at least at one predetermined resonant frequency in a GHz frequency range.

2. The discrete resonator of claim 1, wherein said dielectric material comprises a ceramic.

3. The discrete resonator of claim 1, wherein said dielectric material is a low loss tangent, temperature stable dielectric material selected from the group consisting of $Al_2O_3$, fused silica and MgO.

4. The discrete resonator of claim 1, wherein said at least one predetermined resonant frequency is in the range of 1 GHz to 80 GHz.

5. The discrete resonator of claim 1, wherein said dielectric base consists of a single monolithic fired dielectric ceramic body.

6. The discrete resonator of claim 1, wherein said width and said length of said dielectric base are each selected such that an electromagnetic field intensity within said dielectric base is greatest proximate a two-dimensional geometric center of said dielectric base, and wherein said at least one metal contact is positioned in a location that is spaced a distance from said geometric center.

7. The discrete resonator of claim 6, wherein said at least one metal contact is positioned proximate one of said first and said second end edges of said dielectric base along said length thereof.

8. The discrete resonator of claim 7, wherein said dielectric base has a longitudinal center line extending from said first end edge of said dielectric base toward said opposed second end edge of said dielectric base along said length thereof, and wherein said at least one metal contact is laterally offset from said longitudinal center line.

9. The discrete resonator of claim 7, wherein said dielectric base has a longitudinal center line extending from said first end edge of said dielectric base toward said opposed second end edge of said dielectric base along said length thereof, and wherein said at least one metal contact is centered on said longitudinal center line.

10. The discrete resonator of claim 1, further comprising another isolation region that is free from said ground coating provided on said one of said first and said second major surfaces of said dielectric base such that said discrete resonator has a different predetermined resonant frequency from said at least one predetermined resonant frequency.

11. The discrete resonator of claim 1, wherein said at least one metal contact and said metal ground coating comprise an electrically conductive metal selected from the group consisting of gold, copper, and silver.

12. The discrete resonator of claim 11, further comprising a surface finish provided on said metal contact and said metal ground coating.

13. The discrete resonator of claim 12, wherein said surface finish comprises one of nickel plating and gold plating.

14. A discrete cavity filter consisting essentially of:

a single cavity dielectric base comprising a dielectric material having a dielectric constant, said dielectric base having a width, a length greater than said width defined between a first end and an opposed second end of said dielectric base, a thickness and an outer surface defining first and second opposed major surfaces, peripheral side surfaces and first and second opposed end surfaces of said dielectric base;

a planar first metal contact having a predetermined area disposed in a predetermined location only on one of said first and said second major surfaces of said dielectric base proximate said first end of said dielectric base, wherein a planar bottom surface of said first metal contact is substantially coplanar with respect to a main plane of said one of said first and said second major surfaces of said dielectric base;

a planar second metal contact having a predetermined area disposed in a predetermined location only on said one of said first and said second major surfaces of said dielectric base proximate said second end of said dielectric base, wherein a planar bottom surface of said second metal contact is substantially coplanar with respect to a main plane of said one of said first and said second major surfaces of said dielectric base;

a metal ground entirely covering said outer surface of said dielectric base with the exception of said first and second metal contacts, a first isolation region surrounding said first metal contact and a second isolation region surrounding said second metal contact, each said first and said second isolation regions being free of said metal ground coating and each having a sufficient area to prevent significant coupling between a respective one of said first and said second metal contacts and said metal ground coating;

wherein said first and second metal contacts are capacitively coupled to said single cavity of said dielectric base;

wherein said dielectric constant, said width and said length of said dielectric base are each selected such that a discrete resonator defined at least by said single cavity dielectric base, said first metal contact, said second metal contact, said metal ground coating and said first and second isolation regions resonates at least at one predetermined resonant frequency in a GHz frequency range;

wherein said predetermined areas and said predetermined locations of said first and said second metal contacts respectively provide predetermined loaded Q values for said discrete resonator with respect to said first and second metal contacts; and wherein an electric transfer function between said first metal contact and said second metal contact implements a band pass filter response.

* * * * *